United States Patent [19]

Edminster

[11] Patent Number: 5,016,532

[45] Date of Patent: May 21, 1991

[54] SAFE AND ARM DEVICE

[75] Inventor: Robert E. Edminster, Scottsdale, Ariz.

[73] Assignee: Motorola, Inc., Schaumburg, Ill.

[21] Appl. No.: 547,526

[22] Filed: Jul. 5, 1990

Related U.S. Application Data

[63] Continuation-in-part of Ser. No. 431,253, Nov. 3, 1989, abandoned.

[51] Int. Cl.[5] ..... F42C 15/34; F42C 15/40; F42C 19/00

[52] U.S. Cl. ..... 102/254; 102/221

[58] Field of Search ..... 102/228, 262, 221, 254, 102/225, 226

[56] References Cited

U.S. PATENT DOCUMENTS

| | | | |
|---|---|---|---|
| 2,644,398 | 7/1953 | Rabinow | 102/228 |
| 3,140,661 | 7/1964 | Clarke | 102/225 |
| 3,670,656 | 6/1972 | Donahue et al. | 102/228 |
| 3,961,577 | 6/1976 | O'Steen | 102/226 |
| 3,968,751 | 7/1976 | Palifka | 102/228 |
| 4,019,441 | 4/1977 | Morgen et al. | 102/262 |
| 4,188,885 | 2/1980 | Wolf et al. | 102/221 |
| 4,615,269 | 10/1986 | Holder | 102/221 |
| 4,635,552 | 1/1987 | Battle | 102/254 |
| 4,793,257 | 12/1988 | Bolieau | 102/221 |

*Primary Examiner*—David H. Brown

*Attorney, Agent, or Firm*—Jordan C. Powell; Frank J. Bogacz

[57] ABSTRACT

A safing and arming device for a munition fuze operates without the use of stored energy. The safing and arming device is controlled by a solenoid rotating a rotor and shutter in a ratchet fashion. As the shutter is rotated, a detonating device is brought into position over an explosive lead charge. The design of the rotor and shutter ensures that the detonator is not aligned with the lead charge until after several safety steps have been completed, after which the shutter quickly arms the fuze. Energy is generated for fuze arming during the completion of the safety steps. The design of the safing and arming device minimizes power requirements for safing and arming the fuze.

18 Claims, 3 Drawing Sheets

FIG. 1
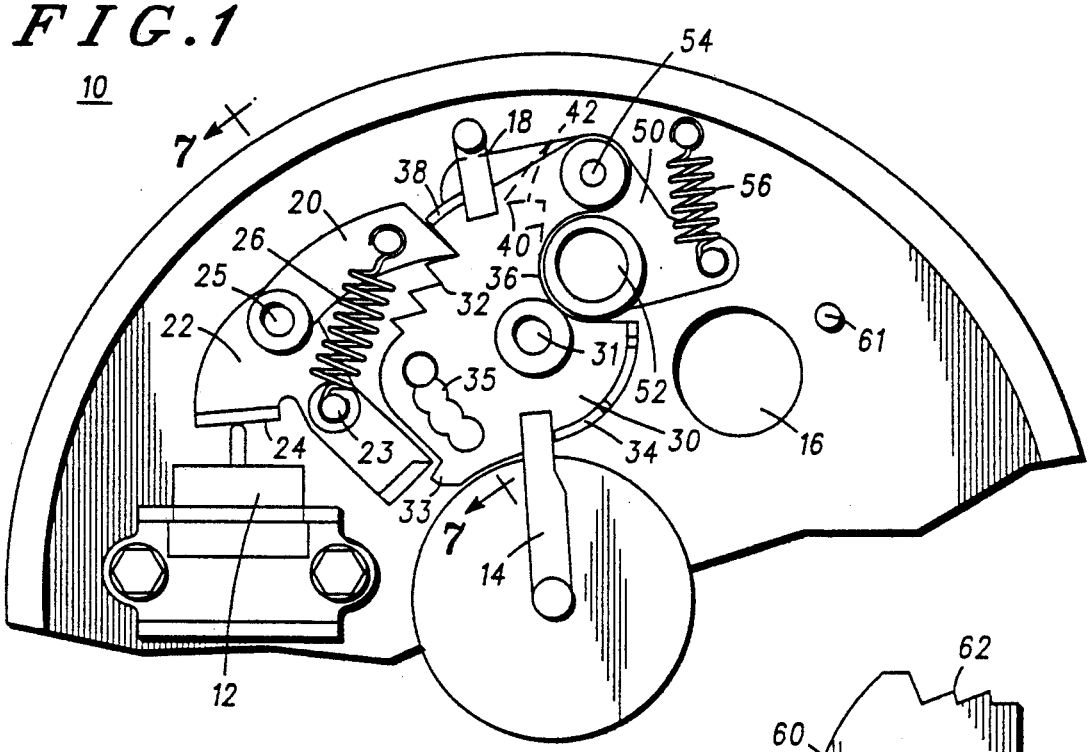
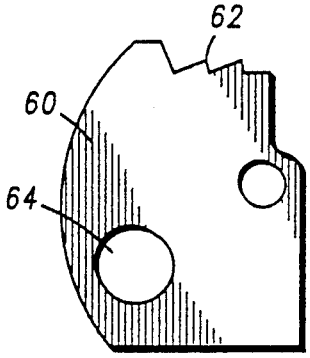
FIG. 2
FIG. 3
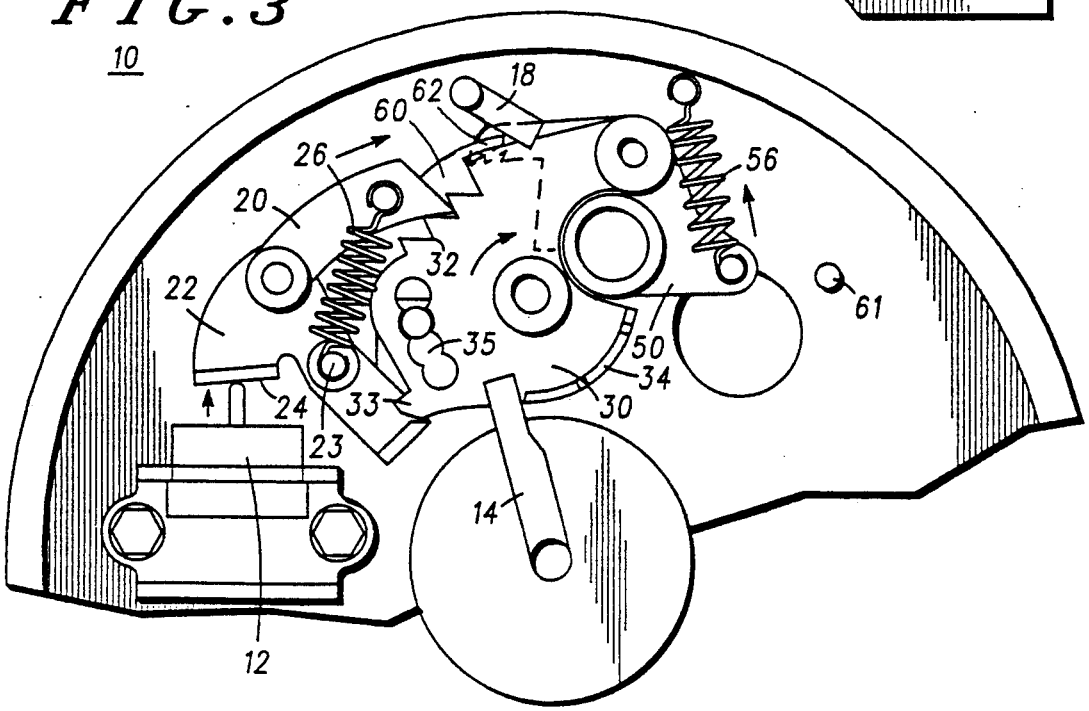

SAFE AND ARM DEVICE

This application is a continuation-in-part of prior application Ser. No. 431,253, filed Nov. 3, 1989, now abandoned.

BACKGROUND OF THE INVENTION

This invention relates, in general, to fuzes for exploding projectiles, and more specifically, to safing and arming devices.

Most safing and arming devices for exploding projectile fuzes utilize stored energy in one form or another. These safing and arming devices often use explosives to remove safety locks and to arm the fuze. The safing and arming devices are dangerous, however, because the explosives can ignite from the heat of a fire. Such heat can be generated during a munition fire.

Fuzes that initiate Department of Defense explosives must comply with strict safety requirements including MIL-STD-1316, Safety Criteria for Fuze Design. A recent revision C, paragraph 5.2.1, requires that "fuze safety systems should not utilize stored energy to remove safety features or provide arming energy unless no adequate environmentally derived energy is available. Stored energy includes batteries, cocked springs, and explosives.

SUMMARY OF THE INVENTION

Accordingly, it is an object of the present invention to provide a safing and arming device which uses only environmental energy and no stored energy.

A safing and arming device for a munition fuze operates without the use of stored energy. The safing and arming device is controlled by a solenoid rotating a rotor and shutter in a ratchet fashion. As the shutter is rotated, a detonating device is brought into position over an explosive lead charge. The design of the rotor and shutter ensures that the detonator is not aligned with the lead charge until after several safety steps have been completed, after which the shutter quickly arms the fuze. Energy is generated for fuze arming during the completion of the safety steps. The design of the safing and arming device minimizes power requirements for safing and arming the fuze.

The above and other objects, features, and advantages of the present invention will be better understood from the following detailed description taken in conjunction with the accompanying drawings.

BRIEF DESCRIPTION OF THE DRAWING

FIG. 1 is a top view of a safing and arming device according to the present invention.

FIG. 2 is a drawing of a component of the safing and arming device of FIG. 1 according to the present invention.

FIG. 3 is a diagram of the present invention in its first stage of operation.

DETAILED DESCRIPTION OF THE INVENTION

Figure 4:
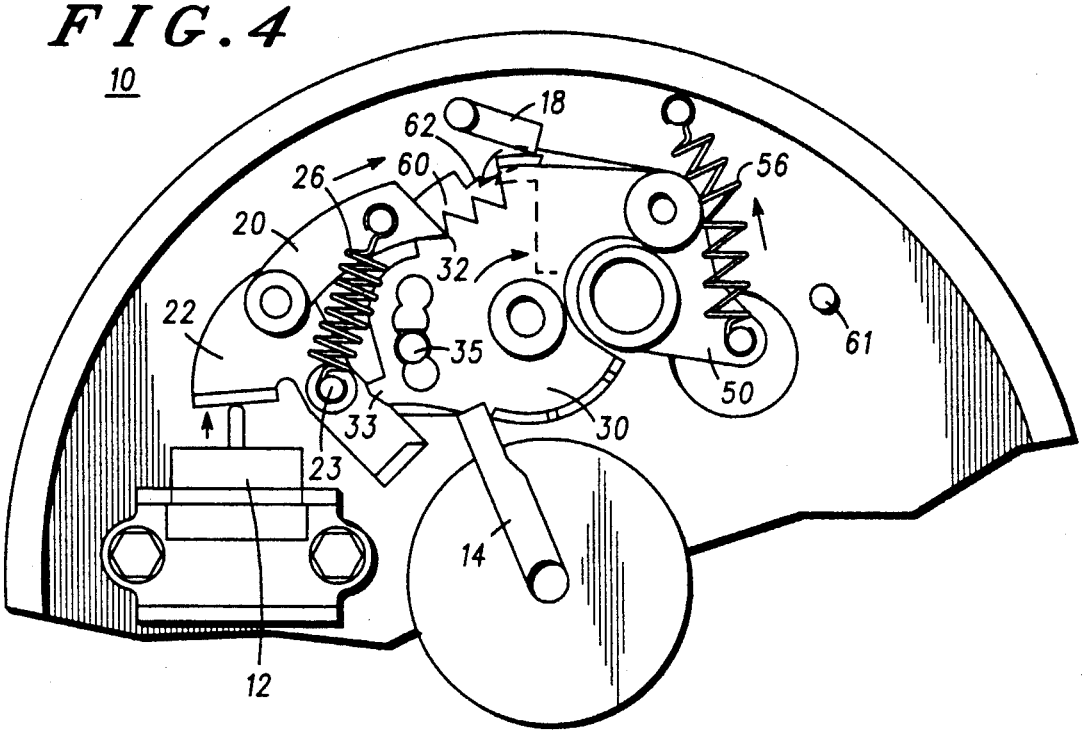
FIG. 4 is a diagram of the present invention in its second stage of operation.

The present invention uses miniature electronically operated solenoids to power and interlock a safe and arm device. The safe and arm device moves an associated electrically ignited, powerful explosive from a safe out-of-line position to an armed in-line position. The armed position aligns the explosive with a second, destructive explosive.

By using a unique method of mounting and powering a shutter on a rotor, the arming sequence can be safely accomplished in a very short time (300 milliseconds) and with minimal power (one watt second for given applications). The rotor is moved in three steps by a ratcheting action caused by one of the solenoids. As the rotor rotates, the mounted shutter also rotates, stretching a power spring. The power spring initially has no stored energy. The powerful explosive is kept out of line until all three rotor steps are completed. At this time, the shutter is released quickly bringing the two explosives into alignment. The alignment occurs within the last few milliseconds of the operation. Without the shutter action, the power explosive would be unsafe by eclipsing the second explosive on the first step of the operation.

Only three ratchtets are possible with very short distances of travel (0.50" for given applications) because of the limited time and power available.

A safe and arming device (SA) 10 is shown in FIG. 1 which operates on environmentally derived energy; no stored energy is required. SA 10 is at its resting position in FIG. 1. In this condition, SA 10 cannot be jolted into armed position, nor can SA 10 be detonated from extreme heat.

SA 10 is constructed to fit into cavities designed for existing fuzes such as those used in Air Force munitions. SA 10 requires about half the area needed for prior safing and arming devices in existing fuzes.

SA 10 comprises solenoid 12, pawl 20, pawl arm 22, rotor 30, gag rod 14, and shutter 50. SA 10 also includes ratchet plate 60 which is shown in FIG. 2 and hidden in FIG. 1. A lead charge is located in lead charge hole 16.

Pawl arm 22 rotates about coupler 23, and has a face 24 which is always in contact with solenoid 12. Coupler 23 couples pawl arm 22 to the housing of SA 10. Pawl 20 is coupled on one end, and rotates about, coupler 25. Coupler 25 couples only pawl arm 22 and pawl 20 together and allows rotation of pawl 20 about the axis of coupler 25. Pawl 20 is coupled to pawl spring 26 which is at rest in FIG. 1. Pawl spring 26 couples pawl 20 to pawl arm 22 at coupler 23.

Figure 7:
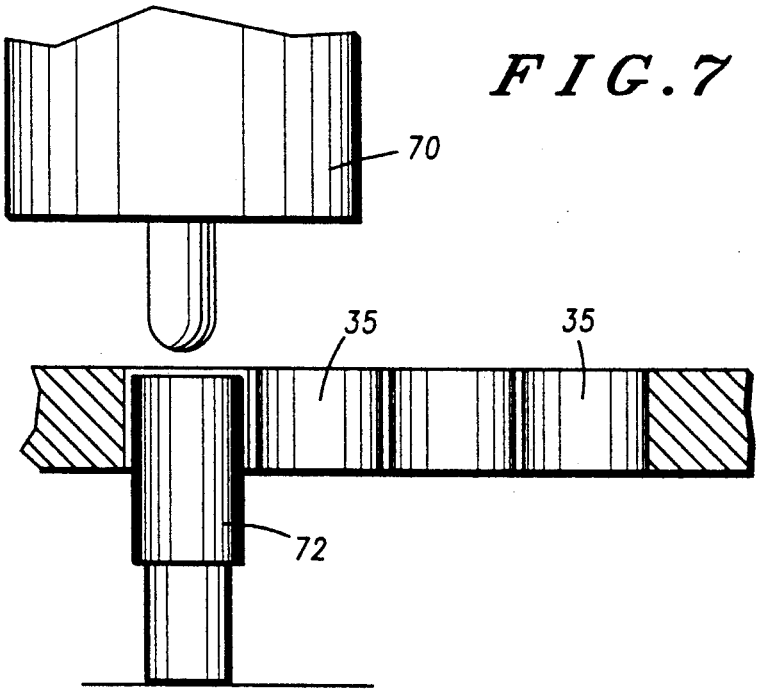
FIG. 7 is a cut-away side view along view 7—7 of FIG. 1.

Rotor 30 rotates about coupler 31 which couples rotor 30 to the housing of SA 10. Rotor 30 comprises ratchet grooves 32, first lip 33, second lip 34, and lock holes 35. As seen in FIG. 1, a narrow corner of pawl 20 rests in a first groove of ratchet grooves 32. First lip 33 abuts against pawl arm 22 when SA 10 is at rest. The abutting prevents rotor 30 from rotating out of position. Second lip 34 abutts against gag rod 14. Gag rod 14 further prevents rotor 30 from rotating. Gag rod 14 moves only in a perpendicular direction with respect to SA 10. When gag rod 14 is pushed away from rotor 30, second lip 34 may pass under gag rod 14 allowing rotor 30 to rotate. A lock solenoid 70 of FIG. 7 repeatedly indexes a lock solenoid plunger 72 (also FIG. 7). Lock solenoid plunger 72 is inserted into lock holes 35 as shown in FIG. 7. Lock solenoid plunger 72 is spring loaded to allow lock solenoid 70 to push it out of lock holes 35 and unlock rotor 30.

Lock solenoid and all other solenoids of the present invention, may be powered from the same source such as powered by a wind driven generator (not shown). Wind driven generators are currently used in Air Force munitions which are released from aircrafts. The turbine of the generator is initially resting within the munition. At the time the munition is released, a lanyard connecting the generator to the aircraft is pulled taut due to the falling of the munition. The tautness of the lanyard pulls the turbine into a position perpendicular to the length of the munition to allow the air passing the body of the munition to turn the turbine at very high rotations. A pin coupling the lanyard to the generator is then sheered off. The current generated by the wind driven generator due to the spinning turbine is used to operate lock solenoid 70, and other solenoids described hereafter. Power is intermitantly supplied from the wind driven generator to the solenoids through a control circuit associated with the wind driven generator.

The requirement for use of environmental energy is derived from the use of the wind driven generator. No energy is stored to operate lock solenoid and unlock rotor 30. However, when the wind driven generator is exposed to the wind (a force derived from the environment of the munition), a current is generated and the solenoids are activated. No other current or force will allow rotor 30 to be unlocked and therefore rotate.

Referring again to FIG. 1, rotor 30 further comprises shutter groove 36. A detonator 52 of shutter 50 is secured in shutter groove 36 until arming of the fuze is desired.

Ratchet plate 60 is stationary below rotor 30. As seen in FIG. 2, ratchet plate 60 comprises stepped grooves 62. Portions of stepped grooves 62 are shown by hidden line 40 of FIG. 1. Lock solenoid plunger 72 which operates to lock rotor 30 extends through hole 64 of FIG. 2 into lock holes 35 FIG. 1. Lock solenoid plunger 72 is pushed out of lock holes 35 during rotation of rotor 30 by lock solenoid 70.

Shutter 50 rotates about coupler 54 which couples rotor 30 and shutter 50. Shutter 50 is coupled at one end in tension to the housing of SA 10 by spring 56. Before any movement by rotor 30 has occured, spring 56 is at rest and is not in tension. An opposite end of shutter 50 is compressed onto a first step of grooves 62 of ratchet plate 60 of FIG. 2 as shown by hidden line 42 of FIG. 1.

An arming indicator flag 18 is rotatably coupled to the housing of SA 10. A third lip 38 of rotor 30 moves flag 18 from a position indicating safe to a position indicating armed as rotor 30 rotates.

The operation of SA 10 is diagramed in FIGS. 3 through 6. In the first step of operation shown in FIG. 3, gag rod 14 (shown as cut-away) is extended perpendicular to SA 10 allowing second lip 34 to pass underneath. The lock solenoid plunger is pushed out of lock holes 35 allowing rotor 30 to rotate. Solenoid 12 is activated and pushes against face 24 of pawl arm 22. The motion of pawl arm 22 frees first lip 33 from lock position and pushes pawl 20 forward (indicated by the motion arrows). As pawl 20 moves forward, it rotates rotor 30. After a given distance, solenoid 12 is disengaged causing pawl arm 22 to retract to its original position. Tension within spring 26 caused by the movement of pawl 20 away from coupler 23 pulls pawl 20 out of the first groove into the second groove of grooves 32. At the same time, shutter 50 is being rotated by rotor 30. Shutter 50 rotates back along ratchet plate 60 until it passes into a subsequent groove of grooves 62. Tension within spring 56 locks shutter 50 into the subsequent groove of ratchet plate 60. By locking shutter 50 into the groove of ratchet plate 60, rotor 30 is also held in position. Flag 18 is rotated slightly. Further, first lip 33 can no longer be engaged by pawl arm 22. The lock solenoid plunger in hole 64 of FIG. 2 is activated again and is secured through a second hole of lock holes 35 of FIG. 3.

FIG. 4 shows the second stage of operation of SA 10. In this stage, solenoid 12 activates again forcing pawl arm 22 upward, while the lock solenoid plunger is retracted from lock holes 35. The upward motion rotates rotor 30 and shutter 50 one more groove. Again solenoid 12 deactivates retracting pawl arm 22, and the lock solenoid plunger is moved an additional notch in lock holes 35. Shutter 50 is locked into place by an additional groove in plate 60.

Figure 5:
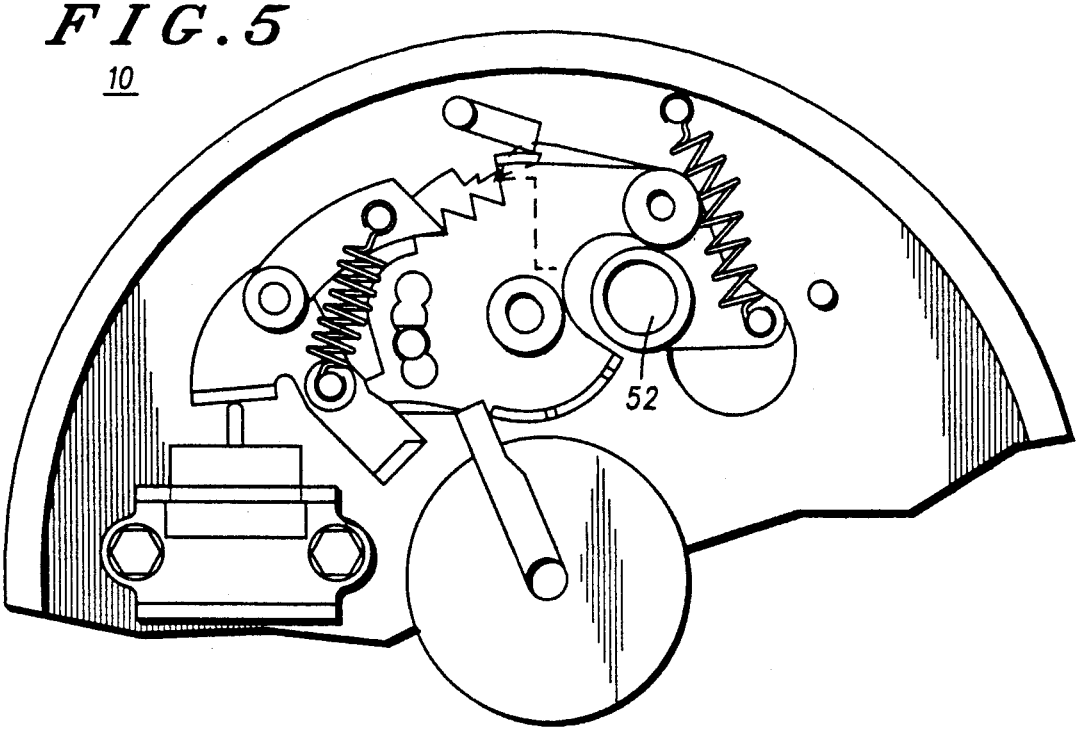
FIG. 5 is a diagram of the present invention in its third stage of operation.

FIG. 5 shows the third stage of rotation. Operation of SA 10 in this stage is similar to the previous stages. As seen in FIG. 5, detonator 52 is very close to arm position, but not directly over the lead charge in lead charge hole 16 of FIG. 1.

Figure 6:
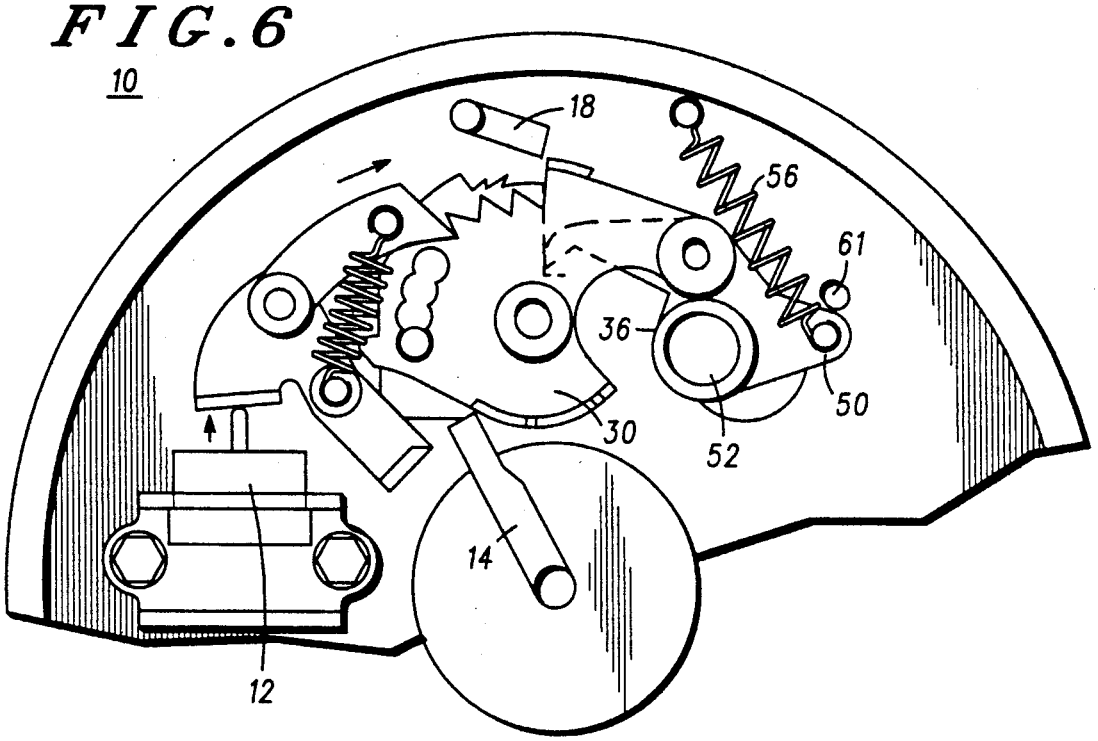
FIG. 6 is a diagram of the present invention in its armed condition.

The final stage of operation, shown in FIG. 6, rotates detonator 52 into arm position over lead charge hole 16 of FIG. 1. In FIG. 6, after solenoid 12 has rotated rotor 30 to its maximum rotation, shutter 50 is freed from shutter groove 36. Tension in spring 56 causes shutter to quickly rotate out of shutter groove 36 and over lead charge hole 16. A stop pin 67 inhibits the progression of shutter 50 as its rotates such that detonator 52 is directly above lead charge hole 16. Flag 18 has been rotated around by rotor 30 such that flag 18 indicates an armed condition to a viewing party. SA 10 is now in an armed condition. A charge to detonator 52 will activate the fuze.

The design of rotor 30 and shutter 50 ensures that detonator 52 is not moved into alignment with the lead charge in lead charge hole 16 until after the third step of rotation of rotor 30 has occured. Furthermore, the ratchet action of rotor 30 minimizes the power required operate SA 10, and ensures that a single power pulse to solenoid 12 will not arm the attached fuze.

Thus there has been provided, in accordance with the present invention, a safing and arming device that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A safe and arm device which operates without the use of energy stored in the safe and arm device wherein the safe and arm device is adapted to a fuze which is armed only when the safe and arm device aligns explosive elements within the fuze, the safe and arm device comprising:

shutter having a detonating device secured thereto;

first means for locking said shutter in a safe position;

second means for unlocking said shutter from said first means;

third means for removing said shutter from said first means in a sudden motion to align the explosive elements of the fuze;

said shutter secured to said first means until said second means unlocks said shutter;

said third means secured to said shutter; and said third means supplying no force on said shutter until said second means begins to unlock said shutter from said first means.

2. A safe and arm device according to claim 1 wherein said first means comprises:

rotor;

said rotor comprising a shutter groove;

said rotor and said shutter coupled together;

said shutter rotating about said coupling; and said shutter groove oriented within said rotor such that said shutter groove locks said shutter in said safe position until said rotor has been rotated.

3. A safe and arm device according to claim 1 wherein said third means comprises a spring.

4. A safe and arm device according to claim 3 wherein said third means further comprises a stop pin.

5. A safe and arm device according to claim 1 wherein the device further comprises:

lock means for locking said first means successively in place; and said lock means coupled to said first means.

6. A safe and arm device according to claim 5 wherein said lock means comprises:

series of interconnecting holes within said first means;

lock solenoid;

lock plunger;

said lock plunger inserted within said series of interconnecting holes; and said lock solenoid pulsing said lock plunger in and out of said series of interconnecting holes.

7. A safe and arm device according to claim 1 wherein said second means comprises a means for rotating said first means.

8. A safe and arm device according to claim 7 wherein said means for rotating said first means comprises:

pawl;

solenoid;

spring;

said solenoid and said spring operating together to cause said pawl to pulsate back and forth; and said pawl pushing against an outer edge of said first means in a pulsating manner to cause said first means to rotate.

9. A safe and arm device according to claim 8 wherein said first means comprises:

rotor;

said rotor comprising ratchet teeth; and said pawl sequentially pushing against said ratchet teeth to cause said rotor to rotate.

10. A safe and arm device which operates without the use of energy stored in the safe and arm device wherein the safe and arm device is adapted to a fuze which is armed only when the safe and arm device aligns explosive elements within the fuze, the fuze being an integral part of a munitions, the safe and arm device comprising:

shutter having a detonating device secured thereto;

first means for locking said shutter in a safe position;

second means for unlocking said shutter from said first means;

third means for removing said shutter from said first means in a sudden motion to align the explosive elements of the fuze;

said shutter secured to said first means until said second means unlocks said shutter;

said third means secured to said shutter; and said third means supplying no force on said shutter until said second means begins to unlock said shutter from said first means.

11. A safe and arm device according to claim 10 wherein said first means comprises:

rotor;

said rotor comprising a shutter groove;

said rotor and said shutter coupled together;

said shutter rotating about said coupling; and said shutter groove oriented within said rotor such that said shutter groove locks said shutter in said safe position until said rotor has been rotated.

12. A safe and arm device according to claim 10 wherein said third means comprises a spring.

13. A safe and arm device according to claim 12 wherein said third means further comprises a stop pin.

14. A safe and arm device according to claim 10 wherein the device further comprises:

lock means for locking said first means successively in place; and said lock means coupled to said first means.

15. A safe and arm device according to claim 14 wherein said lock means comprises:

series of interconnecting holes within said first means;

lock solenoid;

lock plunger;

said lock plunger inserted within said series of interconnecting holes; and said lock solenoid pulsing said lock plunger in and out of said series of interconnecting holes.

16. A safe and arm device according to claim 10 wherein said second means comprises a means for rotating said first means.

17. A safe and arm device according to claim 16 wherein said means for rotating said first means comprises:

pawl;

solenoid;

spring;

said solenoid and said spring operating together to cause said pawl to pulsate back and forth; and said pawl pushing against an outer edge of said first means in a pulsating manner to cause said first means to rotate.

18. A safe and arm device according to claim 17 wherein said first means comprises:

rotor;

said rotor comprising ratchet teeth; and said pawl sequentially pushing against said ratchet teeth to cause said rotor to rotate.

* * * * *